US011268775B2

(12) United States Patent
Blache

(10) Patent No.: US 11,268,775 B2
(45) Date of Patent: Mar. 8, 2022

(54) AUTO-LOADER AND VEHICLE COMPRISING AN AUTO-LOADER

(71) Applicant: RHEINMETALL WAFFE MUNITION GMBH, Unterluess (DE)

(72) Inventor: Andreas Blache, Loerrach (DE)

(73) Assignee: RHEINMETALL WAFFE MUNITION GMBH, Unterluess (DE)

( * ) Notice: Subject to any disclaimer, the term of this patent is extended or adjusted under 35 U.S.C. 154(b) by 0 days.

(21) Appl. No.: 17/074,253

(22) Filed: Oct. 19, 2020

(65) Prior Publication Data

US 2021/0239416 A1 Aug. 5, 2021

Related U.S. Application Data

(63) Continuation of application No. PCT/EP2019/056297, filed on Mar. 13, 2019.

(30) Foreign Application Priority Data

Apr. 17, 2018 (DE) ..... 10 2018 109 154.0

(51) Int. Cl.
*F41A 9/26* (2006.01)
*F41A 9/11* (2006.01)
*F41A 9/42* (2006.01)

(52) U.S. Cl.
CPC *F41A 9/26* (2013.01); *F41A 9/11* (2013.01); *F41A 9/42* (2013.01)

(58) Field of Classification Search
CPC ..... F41A 9/11; F41A 9/26; F41A 9/42; F41A 9/67; F41A 9/76
USPC ..... 89/33.14, 33.16, 45
See application file for complete search history.

(56) References Cited

U.S. PATENT DOCUMENTS 3,724,324 A 4/1973 Zielinski
4,318,331 A 3/1982 Echtler et al.
4,388,854 A * 6/1983 Dabrowski ..... F41A 9/16 89/34
4,487,104 A 12/1984 Schiele et al.
(Continued)

FOREIGN PATENT DOCUMENTS

DE 1938681 A1 2/1971
DE 2948146 A1 6/1980
(Continued)

*Primary Examiner* — Bret Hayes
(74) *Attorney, Agent, or Firm* — Muncy, Geissler, Olds & Lowe, P.C.

(57) ABSTRACT

A vehicle, in particular a tank, having a turret, on which a gun having a large-calibre gun barrel is secured, and comprising an auto-loader positioned behind the turret, via which auto-loader ammunition can be automatically supplied to the gun barrel. In order to achieve simplified automatic loading of the gun barrel with ammunition, the auto-loader is replaceably secured on the outside of the turret as a separate, modular unit. A magazine located in the auto-loader for receiving the ammunition can also be designed as an interchangeable magazine that can be replaced. An electronic system of the auto-loader is housed in the vehicle, specifically in the turret. The selection of ammunition in the auto-loader and the conveying out of the auto-loader are carried out via at least one mechanical interface, e.g. a power take-off, between the turret and the auto-loader.

16 Claims, 5 Drawing Sheets

(56) References Cited

U.S. PATENT DOCUMENTS

| | | | | | |
|---|---|---|---|---|---|
| 4,833,969 | A * | 5/1989 | Winkler | F41A 9/22 | 89/36.13 |
| 4,860,633 | A * | 8/1989 | Wiethoff | F41A 9/16 | 89/45 |
| 4,873,911 | A * | 10/1989 | Suchocki | F41A 9/76 | 89/34 |
| 5,594,192 | A | 1/1997 | Rodriguez | | |
| 6,272,967 | B1 * | 8/2001 | Bender-Zanoni | F41A 9/76 | 89/33.04 |
| 6,279,450 | B1 | 8/2001 | Schmees | | |
| 6,354,183 | B1 * | 3/2002 | Hallqvist | F41A 9/26 | 102/282 |
| 7,159,504 | B2 * | 1/2007 | Heldmann | F41A 9/16 | 89/33.05 |
| 8,215,225 | B1 * | 7/2012 | Zangrando | F41A 9/45 | 89/46 |
| 8,336,442 | B2 * | 12/2012 | Testa | F41A 9/50 | 89/45 |
| 8,607,683 | B1 | 12/2013 | Burgermeister | | |
| 2007/0151440 | A1 * | 7/2007 | Cook | F41A 9/02 | 89/33.17 |
| 2014/0109703 | A1 * | 4/2014 | Howard | F41A 9/42 | 74/57 |

FOREIGN PATENT DOCUMENTS

| | | | | | |
|---|---|---|---|---|---|
| DE | 32 38 893 | C2 | 4/1984 | | |
| DE | 3031203 | C1 | 7/1985 | | |
| DE | 3632451 | A1 | 3/1988 | | |
| DE | 31 32 631 | C2 | 11/1988 | | |
| DE | 69612227 | T2 | 10/2001 | | |
| DE | 199 13 283 | C2 | 1/2003 | | |
| DE | 10 2004 025 743 | A1 | 12/2005 | | |
| EP | 0 022 286 | A1 | 1/1981 | | |
| EP | 0083288 | A1 * | 7/1983 | F41A 9/04 | |
| EP | 0 557 751 | A2 | 9/1993 | | |
| EP | 1 319 916 | A2 | 6/2003 | | |
| FR | 2925149 | A1 * | 6/2009 | F41A 9/76 | |
| WO | WO-0125713 | A1 * | 4/2001 | F41A 9/76 | |

* cited by examiner

AUTO-LOADER AND VEHICLE COMPRISING AN AUTO-LOADER

This nonprovisional application is a continuation of International Application No. PCT/EP2019/056297, which was filed on Mar. 13, 2019, and which claims priority to German Patent Application No. 10 2018 109 154.0, which was filed in Germany on Apr. 17, 2019, and which are both herein incorporated by reference.

BACKGROUND OF THE INVENTION

Field of the Invention

The present invention relates to an automatic loading device (autoloader) for a large-caliber gun. The invention particularly relates to an autoloader which preferably comprises at least one magazine housing and at least one magazine for receiving ammunition. The autoloader may be fitted with or without an (automatic) loading device. The autoloader according to the invention, with or without the loading device, is provided for a vehicle, in particular an armored vehicle with a turret. A gun with a large-caliber barrel is fastened to the turret. The autoloader according to the invention is attached to the outside of the turret or to the outside of the vehicle. The automatic removal of ammunition or cartridges from the magazine and the automatic feeding of ammunition to the barrel take place using the autoloader. The term "vehicle" in this case can also refer to ships, movable and stationary objects, etc., which can accommodate a mounted gun.

Description of the Background Art

In future, main armaments will be integrated in an unmanned, remote-controllable turret, also from the point of view of saving on service personnel. For this purpose, the ammunition for the main armament, e.g. 120 mm or 130 mm tank gun, must be fed automatically from a magazine or the like.

An armored vehicle having an automatic ammunition feed to a large-caliber gun is known from EP 0 022 286 A1, which corresponds to U.S. Pat. No. 4,318,331, for example. In the case of this armored vehicle, the gun is located on a gun turret. At least one ammunition magazine, being an integral part of an automatic loader, is arranged in a vehicle behind the gun turret. The ammunition magazine contains at least one ammunition container, each having a drive with a drive shaft and an endless belt chain in each case. A magazine lock and also a transfer station are introduced between the ammunition magazine and the gun turret. The transfer station comprises, among other things, two laterally arranged pull-out devices for removing the round from the respective ammunition magazine. An ammunition feeding device is made up of a lifting device for raising the rounds to the gun, a load tray for receiving the rounds to be raised, and a rammer for pushing the raised rounds into the gun. A large amount of space is required for this automatic loader.

An armored vehicle with a large-caliber gun is known from DE 26 40 609 A1, which corresponds to U.S. Pat. No. 4,079,659, in which the ammunition magazine is arranged pivotably outside the tray, so that it can be freely pivoted upwards when driving over uneven ground. However, the loading device for the automatic loading of the gun is relatively expensive in the case of this armored vehicle too, since the rounds have to be raised to the level of the barrel and pivoted laterally into the respective position of the barrel following removal from the magazine by means of a pivoting device. The rounds in this case are pushed from below into the rear region of the gun turret.

DE 102 58 263 B4, which corresponds to U.S. Pat. No. 7,159,504, discloses a firing module with a fully automatic round feeding device and a round transfer station with a round rammer arranged on a load tray, so that the round can be introduced into the gun.

DE 199 13 283 C2, which corresponds to U.S. Pat. No. 6,279,450, which is incorporated herein by reference, proposes a loading device for a large-caliber gun with an ammunition magazine arranged behind the gun but in the gun turret. The ammunition magazine in this case is formed by two partial magazines designed to be mirror images of one another. Between the partial magazines a central load tray is located between the partial magazines for loading the gun. In the partial magazines, pieces of ammunition are arranged horizontally alongside one another in multiple layers and are displaceable transversely to the longitudinal axis of the barrel. Feeding takes place via guide rails extending transversely to the longitudinal axis of the barrel. Each piece of ammunition is connected to at least two separate guide parts by means of which they are fed along the guide rails to the barrel. Two-part ammunition can also be fed using the loading device.

A combat vehicle and a method for loading ammunition into combat vehicles is dealt with in EP 2 180 285 A2. An ammunition depot described therein which is located within the vehicle is formed by at least one ammunition cassette which is arranged in a laterally replaceable manner for the loading of ammunition into the vehicle via a vehicle opening. The ammunition lies in compartments behind one another in the cassette. The removal of ammunition from the ammunition cassette takes place in a removal position. Different rounds can be selectively removed from the compartments. It is further proposed that the ammunition cassette is provided with a load coding which is readable. By reading the load coding, the on-board systems obtain information about the of the ammunition cassette.

DE 10 2011 050 637 A1 publishes a loading device which facilitates automatic loading of a large-caliber gun. In order to prevent the ammunition body from slipping out, it is provided that a feeding rammer holding the ammunition body is movably configured in a second direction. The loading device has a load tray, a half-shell-shaped, cylindrical receiving element on which the ammunition body is placed coming from above and can then be pushed via the feed slide in the direction of the loading space. The load tray is connected to a load tray flap on its gun-side end.

DE 602 18 611 T2, which corresponds to US 2003/0140776, provides a device for feeding large-caliber ammunition from a magazine into a loading point of a large-caliber gun. The problem here is that of disclosing an arrangement for selecting ammunition units from an ammunition magazine and then directly transferring said ammunition units to a loading position by means of a simple device which only requires a small amount of space in a turret. It is proposed for this purpose, that a transfer mechanism to a loading or ramming position should be mounted directly behind the large-caliber gun. The ammunition magazine in this case is installed in the gun turret.

SUMMARY OF THE INVENTION

It is therefore an object of the present invention to provide a simple automatic loader, or an autoloader, in particular for an armored vehicle of the kind referred to above.

The invention is essentially based on the principle of creating a simple autoloader which at least comprises a minimum of one magazine housing and at least one magazine, with or without a loading device. The magazine is used to receive ammunition in this case. The ammunition can be automatically selected and automatically fed to the loading chamber of a gun.

If the gun and magazine are arranged close together, the loading device itself can retain a compact design. The loading device can be integrated in the magazine housing. The loading device may, however, also be arranged in the magazine and be a constituent part of the magazine. Alternatively, the loading device may be provided on the gun side or on the vehicle side.

According to an exemplary embodiment of the invention, the autoloader can be arranged outside the turret, preferably outside the vehicle. By arranging the autoloader outside the turret and the tray of the vehicle, the volume of the vehicle to be protected with corresponding armor-plating can be substantially reduced.

The magazine housing need not be correspondingly armor-plated. The weight of the vehicle, in particular of the armored vehicle, is thereby reduced without endangering the safety of the crew. However, the protection should be configured in such a manner that it is able to withstand shelling, depending on the design. The magazine should be at least resistant to shelling with 14.5 mm AP (SK4) and, where required, also to 30 mm APFSDS-T, depending on the design.

The magazine housing itself is designed in such a manner in this case that a blowout is possible in the event of a hit. In other words, if there should be a hit which overwhelms and penetrates the magazine housing with the chosen protection class and can lead to a reaction in the ammunition, a pressure release takes place through flaps, cover plates, etc. in such a manner that there can be no negative repercussions for the turret structure and/or the vehicle.

A modular design of the turret and the autoloader as main system assemblies—gun, loader and magazine—is also preferred. The advantage of this is that the autoloader can also be replaced as a whole. Particularly when damaged by a hit, it is thereby possible for the entire autoloader (compartment with or without loading function) to be replaced.

In a development of the invention, at least one ammunition partition between the autoloader and the highly protected turret structure is appropriate, which partition closes off the openings between the autoloader and the turret/vehicle.

A loading logic control system, i.e. the electronic system of the autoloader, is preferably arranged in the highly protected part of the turret or vehicle according to the invention. This logic system drives or controls mechanisms in the turret/vehicle.

There is a transfer of information from the turret to the autoloader for the selection and conveyance of ammunition with one or multiple separable, preferably purely mechanical, interfaces. Interfaces of this kind are known from tractors, for example. In this case, purely mechanical interfaces are created by a power takeoff shaft, for example. The duration and direction of rotation and speed, etc. control the selection of ammunition and the conveyance thereof in the anticipated application.

An arrangement of this kind of the electronic system of the autoloader in the turret or the vehicle, i.e. outside the autoloader or the magazine housing thereof, turns the autoloader into a cheap replacement part. In the event of a hit and loss of the autoloader, the autoloader can therefore be exchanged without replacing the electronic system. The connection to the expensive electronic system is then made by fitting and fastening a new autoloader, for example, and the autoloader can be made ready for action in the shortest possible time.

With this autoloader, apart from a reliable ammunition feed to the gun, high-speed reloading should also be made possible. For this purpose, it is provided in a development of the invention that the at least one magazine is exchangeable. In a particularly preferred embodiment, the at least one magazine is therefore an exchangeable magazine which can be used in the magazine housing of the autoloader. The advantage of an exchangeable magazine of this kind is that the exercise magazine and the combat magazine can be used both as a single-use and a multi-use magazine.

The preferred integration according to the invention of the loading device in the magazine increases the ease of exchangeability. An adjustment of the magazine to a loading device on the gun side or the vehicle side can be dispensed with.

In a development of the invention, the at least one magazine is configured as an endless belt magazine. Different or various types of ammunition can then also be received in the endless belt magazine. By means of the endless belt, it is possible for the desired type of ammunition to be selected which can then be oriented to the loading device, wherein the magazine can receive multiple different types of ammunition and feed these to the gun once selected.

The loading of the magazine preferably takes place beforehand as combat assembly. This achieves a rapid exchange of the entire magazine on the battlefield. In a magazine that should be regarded as exemplary, the cartridges (ammunition) are preferably arranged horizontally and in corresponding containers or receivers. An ammunition magazine in this case can receive up to 16 pieces of ammunition, for example.

The ammunition can be housed in the container in a load tray-like mount (load tray), i.e. each container contains a load tray and ammunition. The containers in this embodiment are preferably open towards the loading device. The loading device comes into contact with the load tray in order to feed the ammunition and can pull the ammunition plus the load tray out of the magazine. The ammunition (cartridge) is held by bearing points in the load trays, for example. The bearing points may lie on the case base and on the sabot, for example.

Also, only one load tray may also be provided in the magazine as a further embodiment in which the ammunition can be inserted, similarly to DE 199 13 283 C2. In this way, the weight of the magazine can be reduced, for example.

In a simplest embodiment, the loading device comprises a mechanically drivable feed element. The feed element may have toothed segments of a gear rack on the surface which can be driven by a meshing gearwheel and which moves the load tray out of the magazine housing in the direction of the loading chamber of the gun. Alternatives for a simple loading device are possible. This feeding element functionally interacts with the at least one mechanical interface, wherein components are to be provided which can convert a rotational movement into a linear movement, for example. Components of this kind are adequately known in the art.

In order to transport the ammunition from the magazine to the loading chamber of the barrel, the gun turret and the magazine housing preferably have closable openings on their sides facing one another which are arranged in the extension of the axis of the bore of the barrel, if said barrel is located in its indexing position (0° barrel elevation). The respective ammunition to be loaded can be introduced through an axial displacement in this case from the magazine housing into the loading chamber of the barrel. The load tray in this case is oriented to the bore center axis, aligned with the loading chamber of the gun.

The loading action itself begins when the gun has adopted its indexing position (0° barrel elevation). The desired ammunition is selected and moved below, or into the region of, the loading device. The closable openings of the magazine and turret are opened. The loading device arranged in the center of the magazine and oriented to the bore center axis is moved by the at least one mechanical interface with the ammunition up to the main armament. For this purpose, the ammunition is preferably fixed in the loading device. This fixing is removed before or during the feeding of the ammunition to the loading chamber of the gun.

An autoloader and a vehicle with a turret to which a gun with a large-caliber barrel and an autoloader are fastened are proposed according to the invention. The autoloader, comprising at least a magazine housing, a magazine and possibly an automatic loading device, is attached outside, preferably behind, the turret. Vehicles refer to, among other things, armored vehicles, armored fighting vehicles, ships and also stationary objects. Turrets are, among other things, gun turrets or similar superstructures, etc.

In order to facilitate a simpler automatic loading of the barrel with ammunition, compared with comparable vehicles known in the art, without thereby prejudicing the crew's survivability, for example, the invention proposes fastening the autoloader as a separate unit outside the turret in a replaceable manner. For rapid deployment and/or retooling, a magazine located in the autoloader can also be designed in replaceable fashion for receiving ammunition in the form of a replacement magazine. The use of at least two partial magazines which may likewise be replaceable will create the possibility of feeding two-part ammunition as well.

An electronic system of the autoloader can be housed in the vehicle, particularly in the turret. The electronic subassemblies required for the autoloader to operate, including the mechanical drives, may be integrated on the turret side or the vehicle side. The selection of ammunition in the autoloader and the feeding of the ammunition from the autoloader then take place via at least one mechanical interface, e.g. a power takeoff, between the turret and the autoloader.

Combinations of this idea are likewise possible. In this case, part of the electronic system of the autoloader is housed in the vehicle, particularly in the turret, and part of the electronic system in the autoloader itself. These may also be motorized drives, for example. They may be operated via detachable/separable electrical interfaces which likewise allow rapid replacement of the autoloader.

The proposed automatic loading (and unloading) of the gun makes for rapid fire-readiness/safety or a rapid and safe replacement of the ammunition and types of ammunition. In addition, the absence of the magazine and the loading device inside the turret/vehicle means there is sufficient space to accommodate the entire armored vehicle crew exclusively the hull of the armored vehicle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
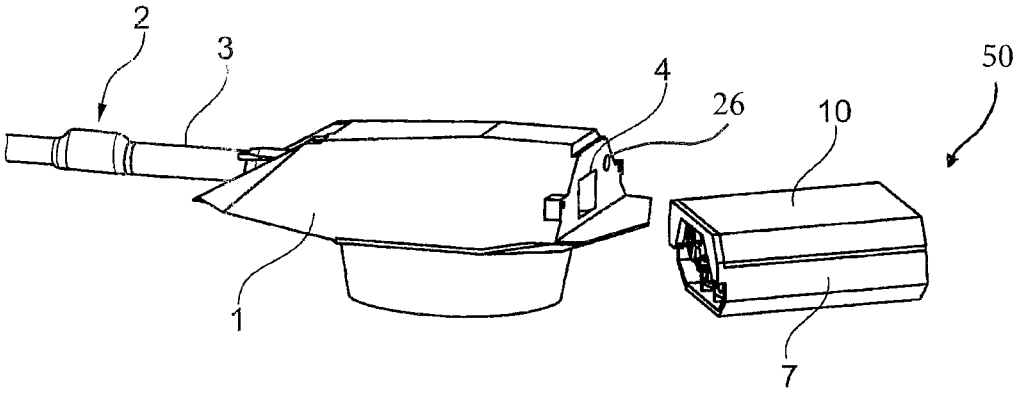
FIG. 1 shows a gun turret only depicted schematically with a gun and ammunition housing of an autoloader before it is fastened to the gun turret.
Figure 2:
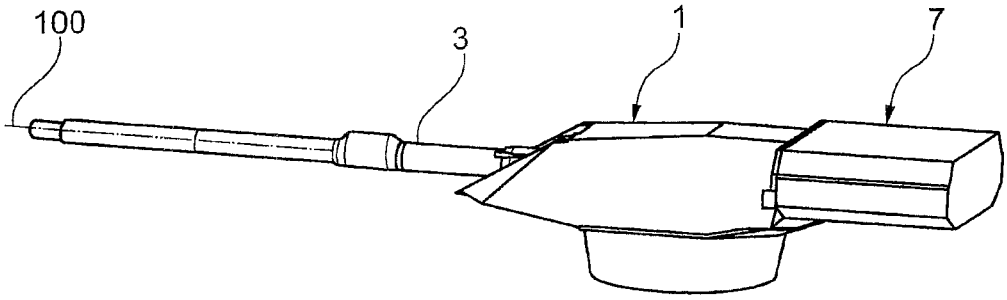
FIG. 2 shows the gun turret depicted in FIG. 1 following the fastening of the ammunition housing of the autoloader to the gun turret.

A rotatable turret (e.g. gun turret, superstructure) of a vehicle 30 (see FIG. 10) which is not itself depicted in greater detail (e.g. armored vehicle, combat vehicle, ship, stationary object, etc.) to which a large-caliber gun 2 with a barrel 3 can be fastened is labelled in the Figure with 1. The turret 1 preferably has a preferably closable, first opening (loading opening) 4 on the rear side, via which ammunition 5 can be fed into the loading space 6 (FIG. 9) of the barrel 3.

On the outside, preferably behind the turret 1, is located an autoloader 50, comprising at least one magazine housing 7, at least one magazine 8, and possibly a loading device 9.

An electronic system 24 of the autoloader 50 can be installed in the turret 1 or in the vehicle. Via at least one mechanical interface 25, for example a power takeoff shaft, a mechanical connection to the magazine 8 is created. By means of the at least one interface 25 (or power takeoff shaft), the ammunition is selected and the selected ammunition 5 fed from the magazine 8, e.g. based on the duration of rotation, rotational direction and/or speed, etc. of the power takeoff shaft.

Figure 3:
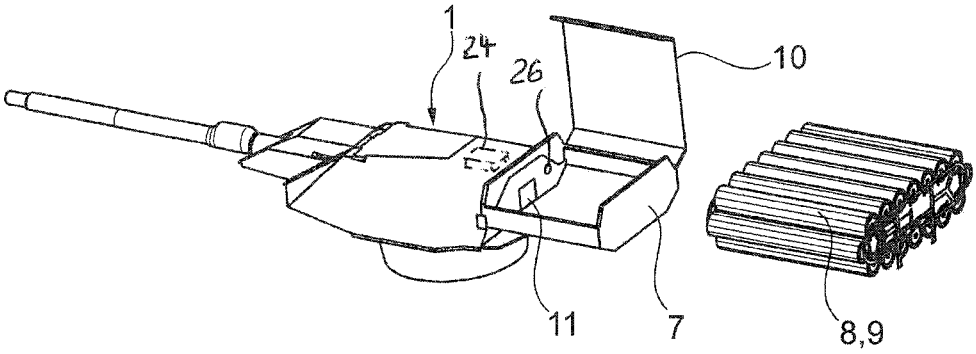
FIGS. 3 and 4 show the arrangement depicted in FIG. 2 with the ammunition housing open before and after the reloading of an ammunition magazine, with integrated loading device.
Figure 4:
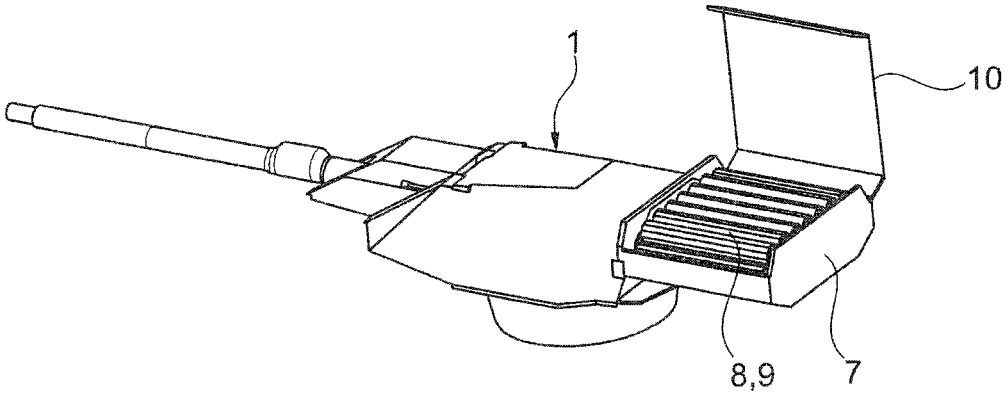

As can be seen from FIGS. 3 and 4, the magazine 8 can also be replaceable, i.e. removed from the magazine housing 7. For this purpose, in the exemplary embodiment shown, the upper side of the magazine housing 7 is configured as a hinged cover 10, so that the magazine 8 can be removed and replaced with a corresponding, new magazine 8. Alternatives to a cover 10 for removal are known in the art.

The magazine housing 7 has on its side facing the turret 1 a preferably closable, second opening (removal opening)

11 as a further ammunition partition which lies opposite the loading opening 4 in the turret 1, through which the ammunition 5 being loaded is conveyed from the magazine housing 7 into the turret 1. In this case, the loading opening 4 and the removal opening 11 are arranged in an extension of the axis of the bore 100 of the barrel 3. The ammunition 5 being loaded in each case can be introduced in this indexing position from the loading device 9 by an axial displacement from the magazine housing 7 into the loading chamber 6 of the gun barrel 3 of the gun 2.

FIGS. 5 to 8 show a possible design of a magazine 8 with a loading device 9. This design should be regarded as exemplary and only depicted schematically.

The at least one magazine 8 can be an endless belt magazine (FIG. 5) in which the ammunition 5 fixed in a load tray 12 in each case is arranged horizontally in containers 13. The arrangement is such that in the case of magazine housings 7 fastened to the turret 1, a projectile part 14 of the respective ammunition 5 is substantially facing the turret 1. The endless belt 15 with the containers 13 provided with a longitudinal slot 16 in each case may be guided by a rack 17. At least two partial magazines of this kind with a common loading position in respect of the gun may also be provided (not shown in greater detail).

Figure 5:
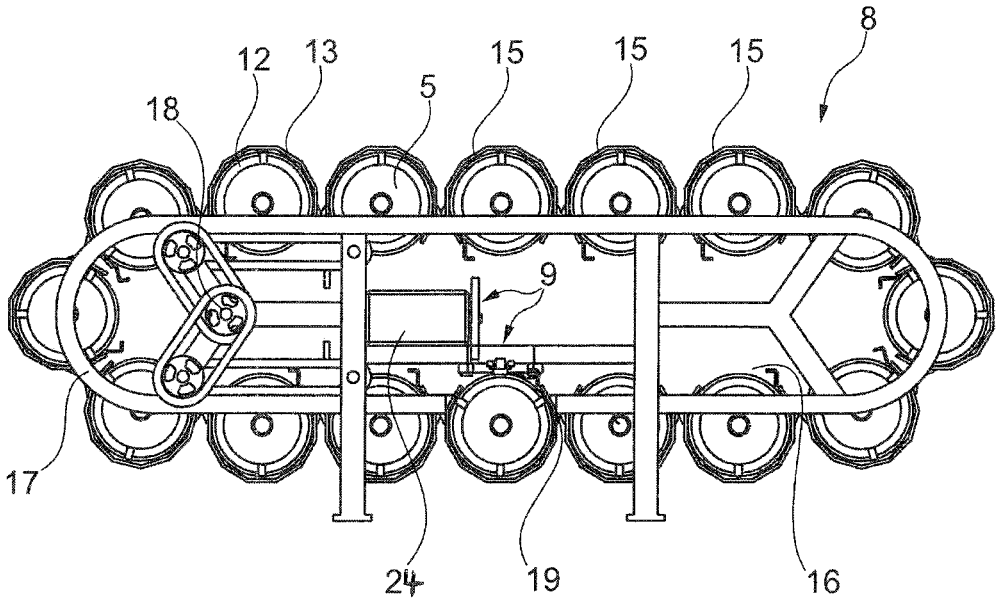
FIG. 5 shows the front view of an exemplary embodiment of an ammunition magazine with integrated loading device.

The removal position in the magazine 8 is located in the center of the lower belt portion of the endless belt 15 in the exemplary embodiment shown in FIG. 5. The rack 17 in this case has a feedthrough 19. The loading device 9 is located above the removal position. The loading device 9 also has a kind of feeding element 9.1 for feeding the ammunition 5 from the ammunition magazine 8 to the loading chamber 6. Together with the at least one mechanical interface 25, the feeding element 9.1 takes over the feeding of the container 13 along with the ammunition 5 in the direction of the loading chamber 6. For this purpose, at least one changeover element (not shown in greater detail) is provided which is able to convert a rotational movement into a longitudinal movement.

Figure 6:
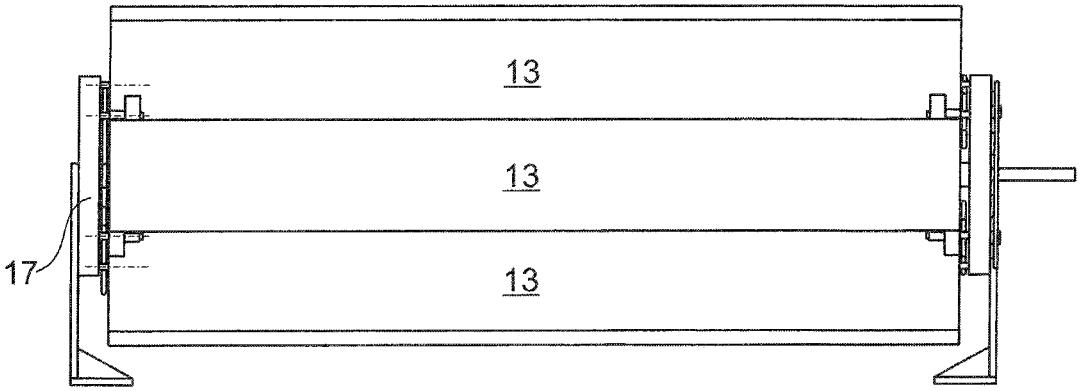
FIG. 6 shows the side view of the ammunition magazine depicted in FIG. 5.
Figure 7:
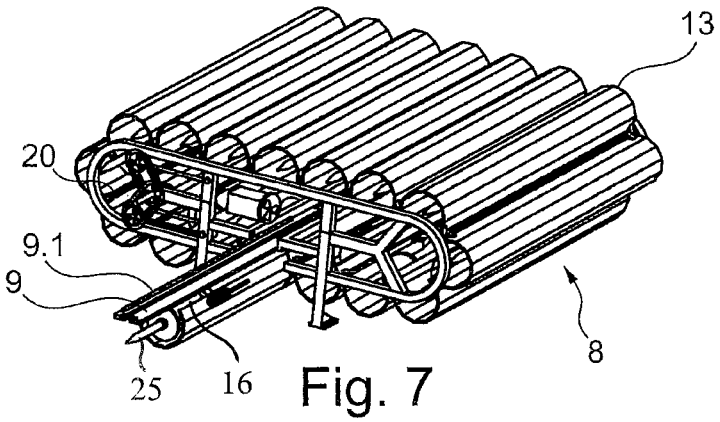
FIG. 7 shows a perspective representation of the ammunition magazine with the loading device and with ammunition held by the loading device.

FIG. 6 shows the magazine 8 in a slightly perspective representation. In each container 13 there is at least one piece of ammunition 5. Different ammunition or various types of ammunition may be introduced in the magazine 5 in this case. The ammunition 5 selected by the weapons system is located through rotation below the loading device 9. This loading device 9 makes contact with the load tray 12 and can carry along the ammunition 5 together with the load tray 12.

Figure 8:
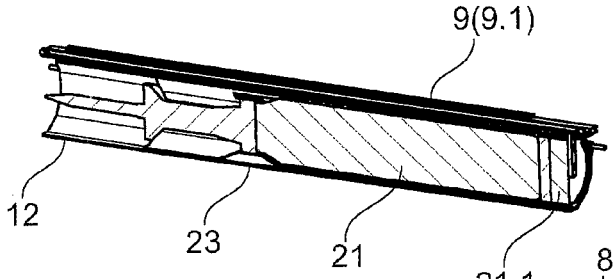
FIG. 8 shows a sectional depiction of the loading device with the ammunition.

FIG. 8 shows a possible fixing 22 of the ammunition 5 in this case within the loading device 9. The mounting of the ammunition 5 with the projectile part 14, cartridge case 21, and sabot 23 preferably has a bearing point (fixing 22) in the region of the sabot 23 and a further bearing point in the region of the case bottom 21.1 of the cartridge case 21.

Figure 9:
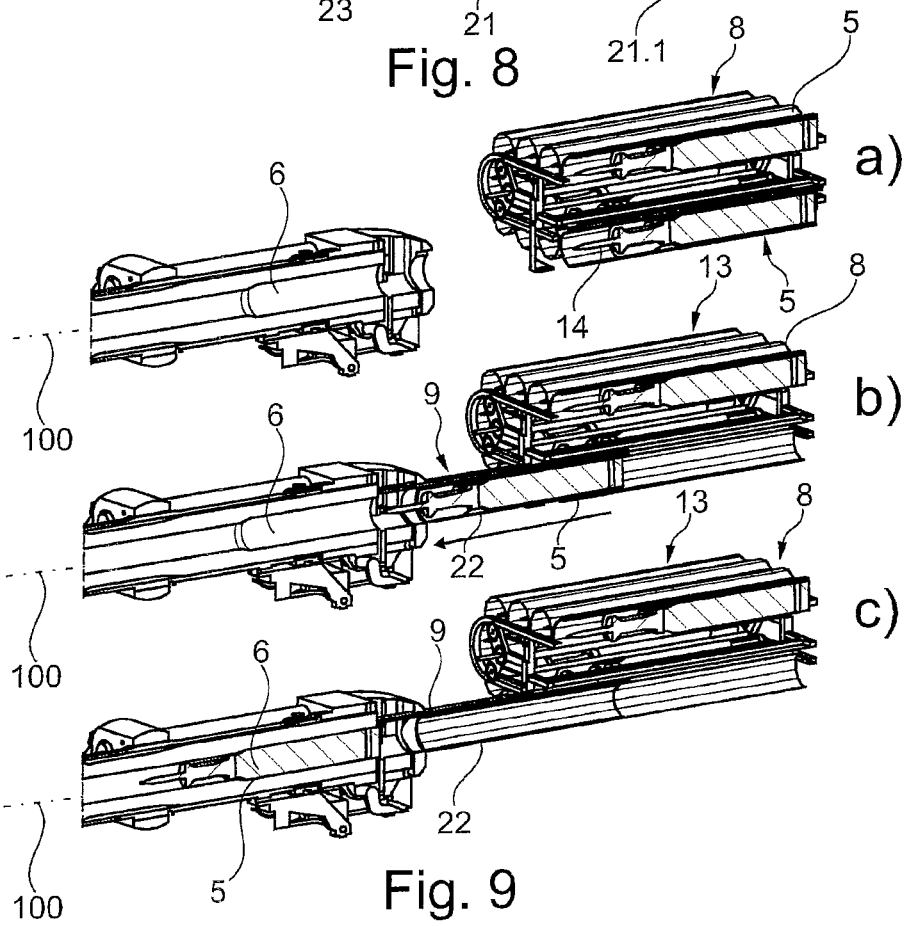
FIG. 9 shows the automatic loading action of the ammunition.
Figure 10:
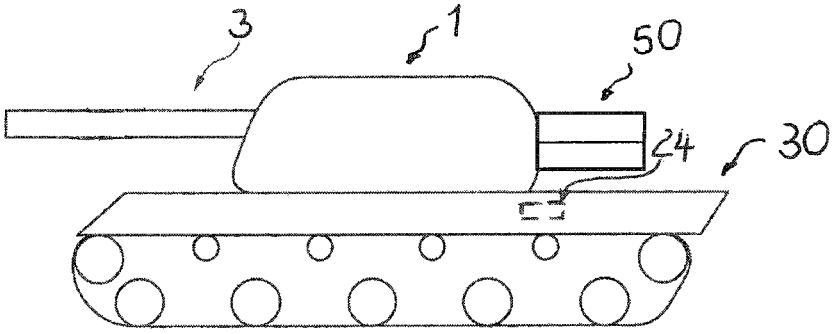
FIG. 10 shows an armored or combat vehicle with the gun, turret and autoloader of FIG. 2 provided thereon.

With the help of FIG. 9 greater detail will be given below of the loading action of ammunition 5 to be newly loaded. In this case, in the present exemplary embodiment, for example, ammunition 5 with a combustible propellant charge and a sabot projectile, e.g. with a caliber of 120 mm or 130 mm, is to be loaded. The wall regions of the magazine housing 7 and of the turret 1 are not shown in the interests of transparency.

The barrel 3 is initially moved into its indexing position and the desired ammunition is selected. The ammunition 5 being loaded is then moved into its removal position (FIG. 5). The removal opening 11 of the magazine housing 7 and also the loading opening 4 of the turret 1 are opened.

Via the at least one mechanical interface 25, the ammunition is selected by rotating the magazine 8. Once the selected or chosen cartridge 5 has reached the region of the loading device 9, the cartridge 5 is fed to the barrel. The loading device 9 then pushes the load tray 12 with the cartridge 5 out of the corresponding container 13 to the rear end of the barrel 3 (FIG. 9*b*).

The fixing 22 of the ammunition 5 in the load tray 12 is then removed. The fixing 22 may be designed in such a manner that with the movement of the ammunition 5 the fixing is pushed outwards by a projectile rammer not depicted in greater detail. The ammunition 5 is pushed into the loading chamber 6 of the barrel 3 (FIG. 9*c*).

Once the projectile rammer and the load tray 12 have been moved back, the gun 2 is locked, the openings 4 and 11 are closed, the gun 2 is aimed, and the release for firing confirmed.

It is self-evident that within the context of the principle of the invention, namely that of the exchangeable autoloader 50, the exchangeable magazine 8, or the exchangeable magazine and the attachment of the autoloader 50 outside the turret or the vehicle, there are numerous further possibilities. Instead of the at least one mechanical interface 25, at least one electrical interface 26 for an electrical actuator, for example a motor, may be provided in the autoloader 50, alternatively or in combination. This electrical interface should likewise be separable and configured as a coupling, for example, so that rapid exchangeability of the autoloader can be further guaranteed. The magazine 8 can then also be rotated via the electrical actuator and the selected ammunition 5 fed to the loading chamber 6 of the gun 2.

The opening and closing of the openings 4, 11 may take place mechanically or electrically.

Alternatively, the loading device may also be attached on the gun side which, for its part, communicates with the autoloader 50 via the at least one mechanical interface 25. A loading device in the magazine 8 can then be dispensed with.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An autoloader comprising:

at least one magazine housing;

at least one magazine for receiving ammunition; and a loading device that transfers the ammunition from the at least one magazine to a loading space of a barrel of a gun, wherein the at least one magazine is housed in the magazine housing, wherein the at least one magazine is configured as an endless belt magazine, wherein the at least one magazine is replaceable, wherein the loading device is housed inside the at least one magazine, and wherein the autoloader, that includes the at least one magazine housing, the at least one magazine and the loading device, is a modular unit, the modular unit being attachable to an exterior of a turret to which the gun is fastened or attachable to an exterior of a vehicle that includes the turret.

2. The autoloader as claimed in claim 1, wherein at least two partial magazines are introduced in the at least one magazine housing.

3. The autoloader as claimed in claim 1, wherein ammunition that are different from one another are adapted to be received in the at least one magazine.

4. The autoloader as claimed in claim 1, wherein pieces of ammunition are arranged substantially horizontally in corresponding containers of the endless belt magazine, wherein at least one of the containers contains a load tray and is provided with a longitudinal slot.

5. The autoloader as claimed in claim 1, wherein the at least one magazine housing is covered by a hinged cover.

6. A vehicle comprising:

a turret to which a gun with a barrel is fastened; and an autoloader as claimed in claim 1, wherein the autoloader is a separate, modular, removable unit that is attached to the exterior of the turret or attached to the exterior of the vehicle, wherein the turret and the autoloader have openings on sides facing one another, and wherein the ammunition is automatically selected and automatically fed to a loading space of the gun.

7. The vehicle as claimed in claim 6, wherein the openings facing one another are arranged in an extension of an axis of a bore of the barrel.

8. The vehicle as claimed in claim 6, wherein the openings are adapted to be closed.

9. The vehicle as claimed in claim 6, wherein the at least one magazine housing is covered by a hinged cover.

10. The vehicle as claimed in claim 6, wherein an electronic system of the autoloader is housed in the vehicle or in the turret.

11. The vehicle as claimed in claim 6, wherein at least one mechanical interface is provided between the turret or the vehicle and the autoloader.

12. The vehicle as claimed in claim 11, wherein the selection of ammunition and the feeding of the ammunition takes place via the at least one mechanical interface.

13. The vehicle as claimed in claim 11, wherein the at least one mechanical interface is a power takeoff shaft.

14. The vehicle as claimed in claim 11, wherein at least one electrical interface is provided between the turret or the vehicle and the autoloader, or wherein a selection and conveyance of ammunition takes place via the at least one mechanical interface.

15. The vehicle as claimed in claim 6, wherein the loading device is housed inside the at least one magazine at a position that is closer to the side of the autoloader that faces the turret than a side of the autoloader that faces away from the turret.

16. A vehicle comprising:

a turret to which a gun with a barrel is fastened;

an autoloader comprising at least one magazine housing and at least one magazine for receiving ammunition, the at least one magazine being accommodated in the at least one magazine housing; and a loading device that is attached to an exterior of the turret or an exterior of the vehicle, wherein the at least one magazine is configured as an endless belt magazine, wherein the at least one magazine is replaceable, wherein the autoloader is a separate, modular, removable unit that is attached to the exterior of the turret or attached to the exterior of the vehicle, wherein the turret and the autoloader have openings on sides facing one another, and wherein the ammunition is automatically selected and automatically fed to a loading space of the gun.

* * * * *